United States Patent [19]

Joffre

[11] 3,932,043

[45] Jan. 13, 1976

[54] APPLICATOR ESPECIALLY ADAPTED FOR APPLYING FLUIDS TO BOWLING LANES AND THE LIKE

[76] Inventor: Robert L. Joffre, 247 Nineteenth Ave., N.W., Barberton, Ohio 44203

[22] Filed: Feb. 12, 1975

[21] Appl. No.: 549,463

[52] U.S. Cl. ..... 401/137; 401/196; 401/205; 401/270

[51] Int. Cl.[2] ..... A47L 1/08; A47L 13/22

[58] Field of Search ..... 401/196, 136–139, 401/205, 206, 270, 272, 244, 275, 289, 48

[56] References Cited

UNITED STATES PATENTS

| | | | |
|---|---|---|---|
| 1,894,420 | 1/1933 | Ranish | 401/275 |
| 1,921,637 | 8/1933 | Ranish | 401/206 |
| 2,805,435 | 9/1957 | Boscarino | 401/205 |
| 2,839,770 | 6/1958 | Boscarino | 401/206 |
| 3,099,035 | 7/1963 | Plost | 401/206 |

*Primary Examiner*—Lawrence Charles
*Attorney, Agent, or Firm*—Isler and Ornstein

[57] ABSTRACT

An applicator is described which is especially adapted for applying lane conditioner, wax and other fluids to bowling lanes for the purpose of cleaning and conditioning the lanes, and to distribute said fluids uniformly and quickly thereover. The applicator comprises a pan-like member having perforations for passage of said fluids therethrough, a mop-like member removably secured to said pan-like member, a pad of highly absorbent, porous and compressible material disposed in said pan-like member, a fluid distributor reservoir supported by said pad, and means, including a handle secured to said distributor reservoir, and effective upon pressure applied thereto to compress the pad and cause fluid to be ejected from said pad through said perforations directly to the surface being conditioned and spread by said mop-like member. Means are provided for removably latching said reservoir to said pan-like member.

9 Claims, 10 Drawing Figures

APPLICATOR ESPECIALLY ADAPTED FOR APPLYING FLUIDS TO BOWLING LANES AND THE LIKE

This invention relates, as indicated, to applicators of the mop type, but has reference more particularly to an applicator which is especially adapted for application of bowling lane conditioners, sometimes called lane oil, while cleaning, wiping and dusting the lane surface.

A primary object of the invention is to provide and applicator of the character described, which is designed not only to apply such fluids to the bowling lanes and the like, but to distribute them quickly and easily over large areas, with a minimum of effort and time involved.

Another object of the invention is to accomplish the conditioning of lanes while cleaning and dusting them in a short period of time.

Another object of the invention is to permit conditioning of lanes at any time that conditioning is deemed necessary, as, for example, just before league play, which is rendered possible due to the short time required to accomplish such conditioning with the applicator of the present invention.

Another object of the invention is to provide an applicator of the character described, which is compact, light in weight, and of simplified design, to enable the lanes to be conditioned without disturbing bowlers at any given period of time.

Another object of the invention is to provide an applicator of the character described, which embodies a pad of porous, compressible material, which is highly absorbent, a distributor reservoir for fluid to be supplied to said pad, and means responsive to pressure applied thereto to compress the pad, to thereby force a portion of the fluid absorbed in the pad to be ejected therefrom through restricted perforations in the bottom of the pan to the surface being conditioned.

A further object of the invention is to provide an applicator of the character described, which consists of parts which can be quickly and easily assembled, and disassembled, for cleaning and maintenance of parts thereof.

Other objects and advantages of my invention will be apparent during the course of the following description.

In the accompanying drawings forming a part of this specification, and in which like numerals are employed to designate like parts throughout the same, FIG. 1 is a top plan view of a fluid applicator for bowling lanes and the like;

Referring more particularly to the drawings, the applicator will be seen to comprise an elongated pan consisting of a bottom 10, upright side walls 11 and 12, and upright end walls 13 and 14.

Figure 3:
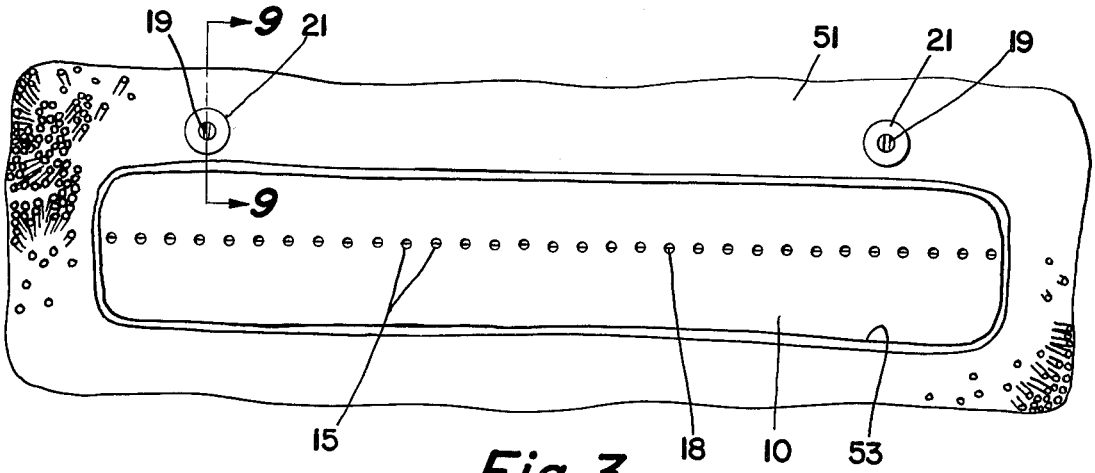
FIG. 3 is a bottom plan view of the applicator.
Figure 5:
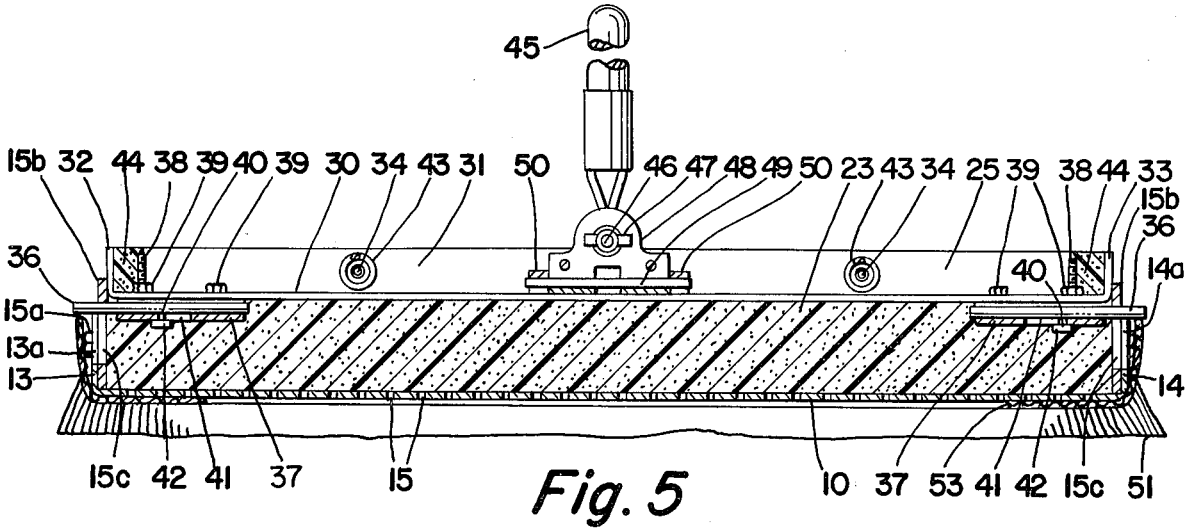
FIG. 5 is a longitudinal cross-sectional view, taken on the line 5—5 of FIG. 1.

The bottom 10 of the pan is provided with a multiplicity of spaced openings or holes 15, which, as best seen in FIGS. 3 and 5, are disposed along the center of the bottom 10.

The end walls 13 and 14, as best seen in FIGS. 1, 2, 4 and 5, have secured thereto, as by means of bolts 15*a*, plates 15*b*.

Figure 4:
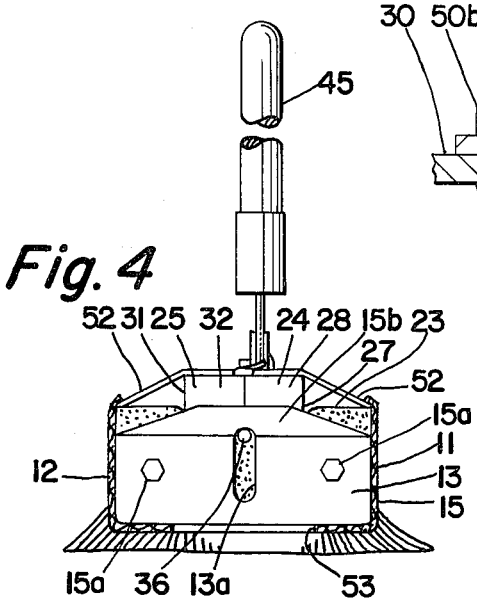
FIG. 4 is a transverse cross-sectional view, taken on the line 4—4 of FIG. 2.
Figure 7A:
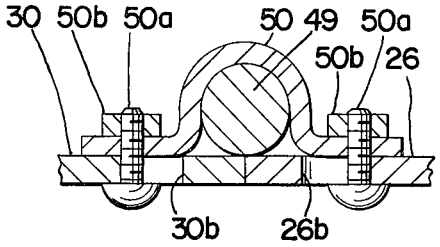
FIG. 7A is a fragmentary cross-sectional view, taken on the line 7A—7A of FIG. 2.

The end walls 13 and 14, as best seen in FIGS. 4 and 5, are respectively provided with slots 13*a* and 14*a*, which are aligned with slots 15*c* in the plates 15*b*, and which serve a purpose to be presently described.

The perforations or holes 15 are designed to permit passage of a cleaning fluid, lane conditioner, liquid wax or other fluid therethrough and onto the bowling lane or other surface, at predetermined intervals, and for the purpose of controlling the amount of such fluid, wax or the like, a plate 18 is provided, which, as best seen in FIGS. 3, 6, 7, 8 and 9, overlies the bottom 10, and is secured to the bottom by means of bolts 19, nuts 20, and washers 21.

The bolts 19 pass through slots 22 in the plate 18, so that when the bolts are loosened, the plate 18 may be adjusted transversely of the bottom 10, to thereby close portions of the perforations 15, and thus control the amount of fluid which passes through these perforations. Following such adjustment, the bolts 19 may be tightened to maintain the plate 18 in adjusted position.

Disposed within the pan which has been described, is a pad or rectangular block 23 of compressible, highly absorbent, porous material, such, for example, as foam rubber, polyurethane foam, or a similar foam-like resin or plastic, such as cellulose, which is easily compressible, but resumes its original shape or form, upon removal of the compressing force.

Mounted upon the pad or block 23 is a fluid reservoir, which consists of a pair of pan-like members of identical construction, designated generally by reference numerals 24 and 25.

The member 24 comprises a bottom 26, an outer side wall 27, and end walls 28 and 29. The member 25 comprises a bottom 30, an outer side wall 31, and end walls 32 and 33.

The members 24 and 25 are maintained with the inner edges of their bottoms 26 and 30 in substantial contiguity with each other, as best seen in FIGS. 1, 5, 6, 7 and 8, by means of bolts 34 and nuts 35. By "substantial contiguity," it will be understood that these edges are not in actual contact with each other, but spaced apart sufficiently to provide a thin slit or slot therebetween which is sufficient to permit passage of a fluid therethrough at all times.

With the members 24 and 25 secured to each other in this manner, they conjointly form a distributor reservoir or pan which contains a supply of the fluid to which reference has been made, and from which the fluid will be slowly drained through the aforesaid slit or slot and distributed to the pad or block 23. The width of this slit may be adjusted in a manner to be presently described.

Figure 6:
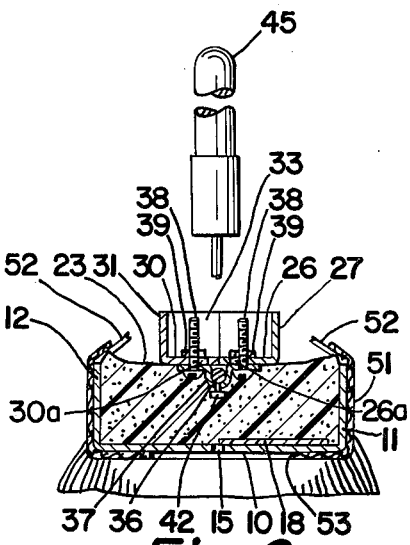
FIG. 6 is a transverse cross-sectional view, taken on the line 6—6 of FIG. 2.
Figure 7:
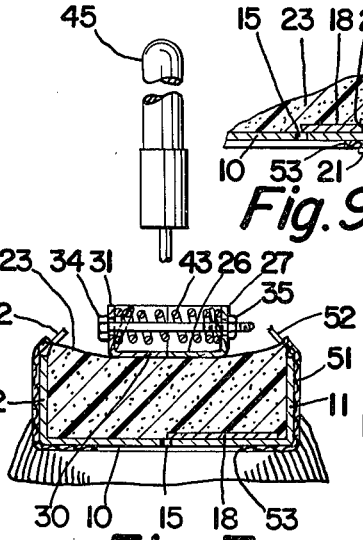
FIG. 7 is a transverse cross-sectional view, taken on the line 7—7 of FIG. 2.
Figure 9:
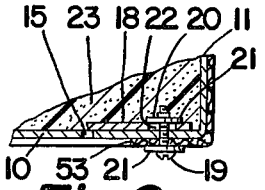
FIG. 9 is a fragmentary cross-sectional view, taken on the line 9—9 of FIG. 3.
Figure 8:
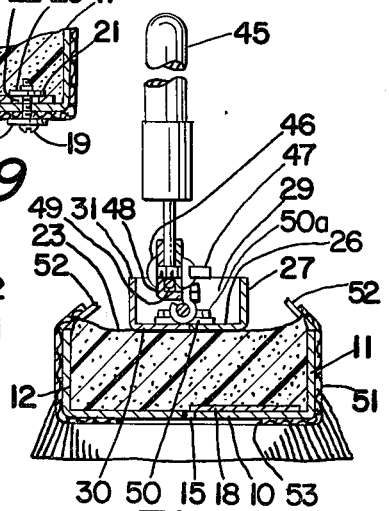
FIG. 8 is a transverse cross-sectional view, taken on the line 8—8 of FIG. 2.

For the purpose of maintaining the members 24 and 25 in the position shown in FIG. 7, there is provided at each end, a latch pin or bolt 36, which is slidably supported in a retainer 37 (see FIG. 6), which is secured to the bottoms 26 and 30, by means of bolts 38 and nuts 39. The bolts 38, as best seen in FIG. 6, pass through transverse slots 26*a* and 30*a* in the bottoms 26 and 30, which slots serve a purpose to be presently described.

The latch pins or bolts 36 are normally maintained in the position shown in FIG. 5, in which position, they extend through the slots 15*c*, 13*a* and 14*a*, and are resiliently biased against the upper ends of these slots by the resiliency of the pad or block 23, which thus assists in maintaining the members 24 and 25 in proper position in relation to the bottom 10 of the pan to which reference has been made.

For the purpose of removing the members 24 and 25, for any reason, such, for example, when the applicator is to be cleaned, or the pad or block 23 is to be replaced, the latch pins or bolts 36 may be retracted from the slots 15*c*, 13*a* and 14*a*. For this purpose, each of the pins or bolts 36 is provided with a donwardly extending pin 40, which extends through a slot 41 in the retainer 37, and terminates in a head 42 of larger diameter than the width of the slot 41, this head 42 thus serving to prevent disassembly of the latch pin or bolt 36 from the retainer 37.

For a purpose to be presently described, a pair of compression coil springs 43 is provided, which springs encompass the bolts 34, and have their ends bearing against the side walls 27 and 31 of the fluid distributor reservoir which has been described.

Interposed between the end walls of the pan or reservoir which has been described, and those of the bolts 38 which are closest to the end walls, are small pads 44 (see FIGS. 1 and 5), which serve a purpose to be presently described.

The applicator further includes a handle 45, which, as best seen in FIGS. 1, 2, 5 and 8, is pivotally secured, as by bolt 46 and wing nut 47, to a bracket 48, which supports a pin or shaft 49.

The pin or shaft 49 has its ends pivotally mounted in brackets 50, which are removably secured to the bottoms 26 and 30 of the members 24 and 25, by means of bolts 50*a* and nuts 56*b* (see FIGS. 1, 2, 7A and 8). For a purpose to be presently described, the bolts 50*a* pass through transverse slots 26*b* and 30*b* in the bottoms 26 and 30.

By thus mounting the handle 45 for pivotal movement about the axis of the bolt 46 and about the axis of the pin or shaft 49, the handle has movement in two planes, which movement not only facilitates use of the applicator, but also permits the handle to be folded against the applicator to facilitate shipment and storage.

Figure 1:
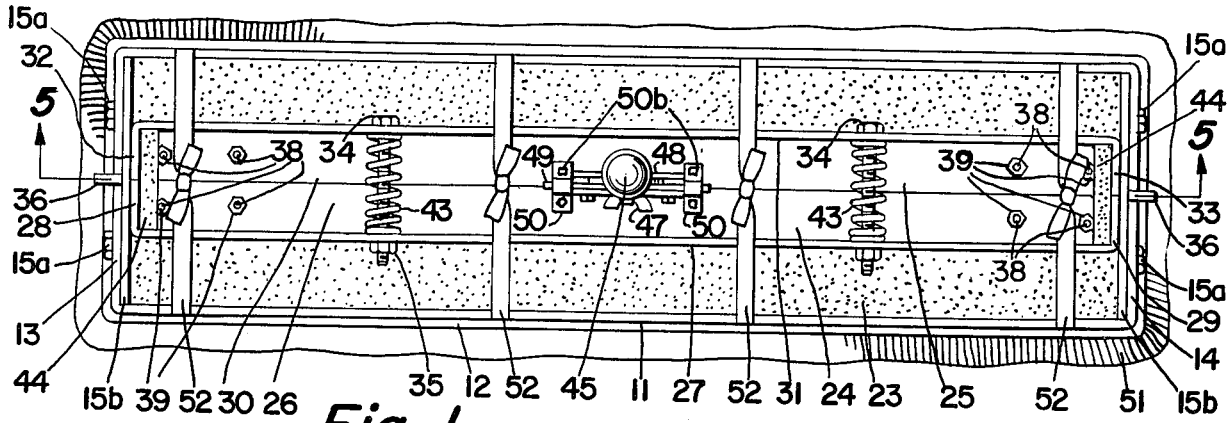
Figure 2:
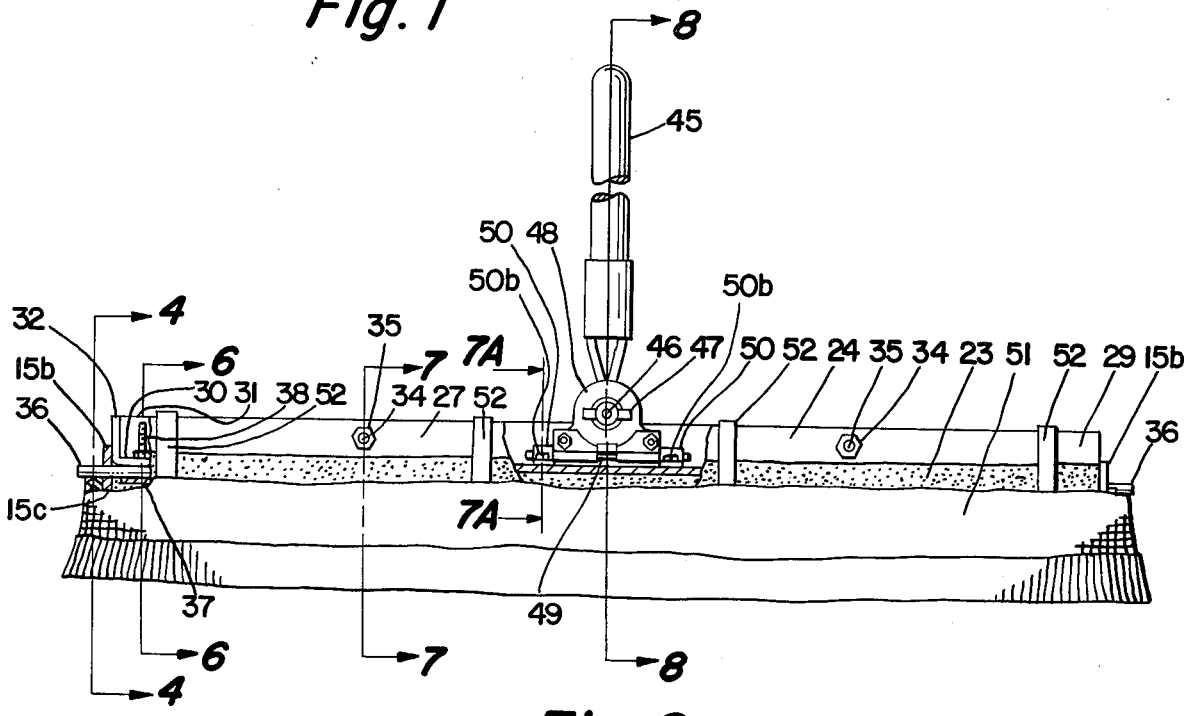
FIG. 2 is a side elevational view of the applicator of FIG. 1, with a portion thereof broken away to more clearly show certain details.

The applicator further includes a mop-like member 51, which is removably secured to the bottom, side walls and end walls of the pan in which the pad 23 is mounted, by means of tapes 52, the ends of which, as seen in FIG. 1, are tied together.

The bottom of this mop-like member is provided with an opening 53, which as best seen in FIGS. 1, 3, 5, 6, 7, 8, and 9, leaves the perforations 15 exposed, so that fluid can pass through these perforations directly onto the bowling lane.

In the use of the applicator, and initially prior to its first use, the applicator pad 23 and mop-like member 51 will be saturated with a predetermined amount of lane conditioner, wax or other fluid. Thereafter, in the use of the applicator, only the pad 23 will be saturated, so that the fluid will be available to pass through the partially restricted perforations 15 directly to the surface to be conditioned and distributed over this surface by the mop-like member 15, and ejection of the fluid from the pad 23 will be caused by manipulation of the handle 45, which, in turn, compresses the pad 23.

Only after about 50 to 75 full ejections of fluid from the pad 23 will it be necessary to pour more fluid into the reservoir, thereby replenishing the fluid supply for the pad 23.

In actual practice, it may be noted that in the use of the applicator, one full depression or compression of pad 23 will eject enough lane conditioner to thoroughly condition not less than four lanes, although one slight ejection per lane has been found to be more satisfactory.

It may be further noted that when the reservoir comprising the members 24 and 25 is depressed, as shown in FIG. 7, pressure of these members is communicated to the pad 23, causing the pad to be squeezed or compressed, and a portion of the fluid therein to be expelled through the perforations 15, and as permitted by adjustment of plate 18, as shown in FIGS. 3, 6, 7 and 8. Plate 18 may be adjusted to restrict the flow through the perforations 18, thereby controlling ejection from pad 23, which ejection is also controlled by the amount of pressure applied to handle 45 and the number of times such pressure is applied.

The small pads 44, as best seen in FIGS. 1 and 5, are utilized to act as seals to prevent fluid poured into the reservoir from leaking endwise from the reservoir, instead of passing through the slit or slot, to which reference has been made.

The width of the aforesaid slit or slot between the inner edges of the bottoms 26 and 30, as shown in FIG. 1, may be adjusted by loosening the nuts 35 to any desired degree, which, in turn, permits the springs 43 to push the members 24 and 25 apart to increase the width of the slit or slot. The fluid in the reservoir leaks slowly and evenly through the slot, throughout its entire length, onto the pad 23.

Prior to loosening of the nuts 35, the nuts 39 and 50*b* are also loosened, to permit the members 24 and 25 to move relatively to the bolts 38 and 50*a*, due to the provision of the slots 26*a*, 30*a*, 26*b* and 30*b*.

It is thus seen that I have provided an applicator which admirably fulfills all of the aforesaid objects.

Instead of utilizing a single pad 23, as described, the pad may be made up of a number of smaller pads in end-to-end relation, or, if desired, a number of such smaller pads less in number than necessary to extend the entire length of the pad-carrying pan, may be used. In some instances, for example, where it is desired to condition only the central portion of a lane, a number of such smaller pads may be placed at the central portion of the pad-carrying pan. Where this is done, seals, similar to the sealing pads 44, may be frictionally secured at positions in the reservoir, such as to confine the fluid in the reservoir to an area equivalent to the area of the smaller pads in the pad-carrying pan.

It is to be understood that the form of my invention, herewith shown and described, is to be taken as a preferred example of the same, and that various changes may be made in the shape, size and arrangement of parts thereof, without departing from the spirit of the invention or the scope of the subjoined claims.

Having thus described my invention, I claim:

1. In an applicator of the character described a pan-like member having perforations in the bottom thereof for passage of a fluid therefrom, a pad of porous, compressible material disposed in said member and adapted to hold fluid in the pores thereof, a pan-like reservoir resiliently supported by said pad and adapted to contain a quantity of said fluid, and a handle, said pan-like reservoir being responsive to downward pressure of said handle to cause fluid in said pad to be discharged through said perforations by compression of the pad.

2. An applicator, as defined in claim 1, wherein said reservoir comprises a pair of members having bottoms in substantially contiguous relationship witheachother, to provide therebetween a slot for exit of fluid from said reservoir.

3. An applicator, as defined in claim 2, including means for adjusting the width of said slot.

4. An applicator, as defined in claim 3, wherein said last-named means comprises compression coil springs.

5. An applicator, as defined in claim 1, including means for releasably latching said reservoir to said pan-like member.

6. An applicator, as defined in claim 1, including mop-like means removably secured to said pan-like member.

7. An applicator, as defined in claim 6, wherein said mop-like member has an opening in the bottom thereof, whereby said perforations are left exposed.

8. An applicator, as defined in claim 1, including a plate secured to said pan-like member, said plate being adjustable to control the quantity of fluid passing through said perforations.

9. An applicator, as defined in claim 1, wherein said handle is pivotally secured to said reservoir.

* * * * *